United States Patent [19]

Duffee

[11] Patent Number: 4,856,697

[45] Date of Patent: Aug. 15, 1989

[54] MANUAL PIN DRIVER

[75] Inventor: Malcolm T. Duffee, Brooklyn, Conn.

[73] Assignee: Spirol International Corporation, Killingly, Conn.

[21] Appl. No.: 152,902

[22] Filed: Feb. 5, 1988

[51] Int. Cl.[4] ..... B25C 1/00

[52] U.S. Cl. ..... 227/149

[58] Field of Search ..... 227/147, 149, 120, 156

[56] References Cited

U.S. PATENT DOCUMENTS

| | | | |
|---|---|---|---|
| 3,788,537 | 1/1974 | Fox | 227/142 |
| 3,982,679 | 9/1976 | White, Jr. | 227/116 |
| 4,065,045 | 12/1977 | Pray | 227/149 X |
| 4,180,195 | 12/1979 | Caley et al. | 227/149 X |
| 4,351,467 | 9/1982 | White | 227/142 |
| 4,385,719 | 5/1983 | Erskine | 227/116 |
| 4,496,092 | 1/1985 | Billing | 227/149 |

*Primary Examiner*—Paul A. Bell

*Attorney, Agent, or Firm*—Hayes & Reinsmith

[57] ABSTRACT

In a manual spring pin inserter, a pair of jaws cooperate with a jaw preloading means to provide increased jaw clamping forces on a pin proportional to advancement of that pin into a hole of a workpiece.

17 Claims, 5 Drawing Sheets

FIG. 2
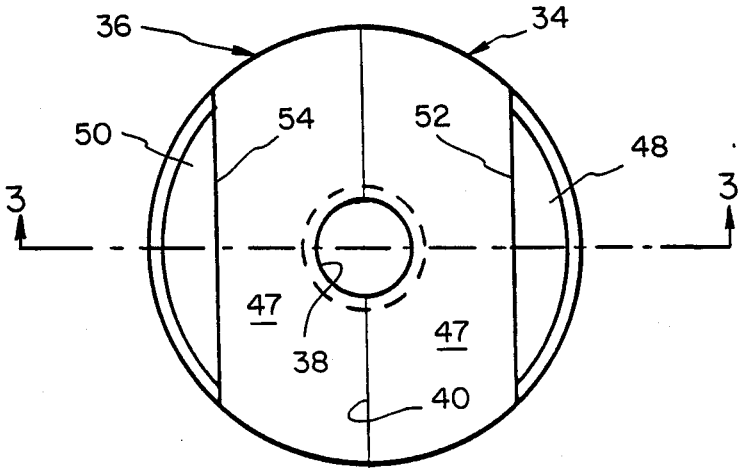
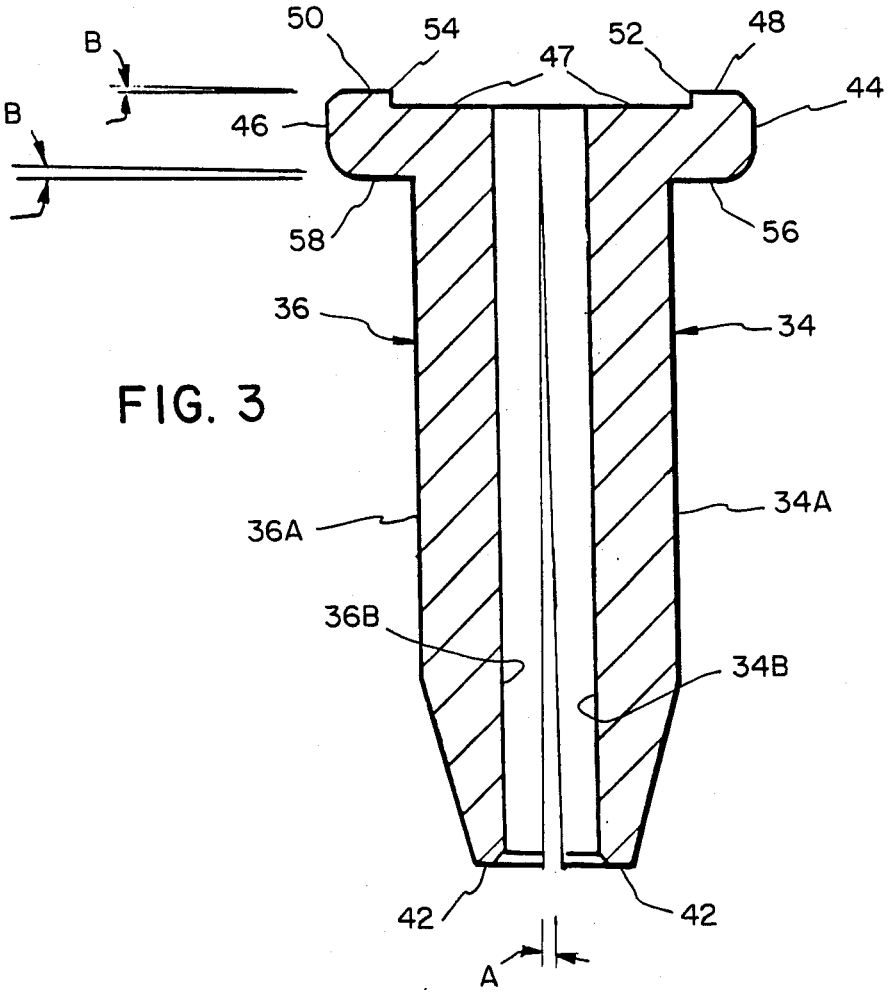
FIG. 3

MANUAL PIN DRIVER

FIELD OF THE INVENTION

This invention relates generally to apparatus for driving a pin into a hole in a workpiece.

BACKGROUND OF THE INVENTION

The apparatus of this invention is directed to driving or inserting pins (such as "Spirol" coiled spring pins made by C.E.M. Co., Inc., Killingly, Connecticut) into holes of workpieces, for example, for anchoring two or more workpieces against relative movement.

Means for inserting such coiled spring pins into workpieces are generally known. However, continued need for such devices exists wherein the pin inserter will provide reliable operation over extended periods of time in a unit which is relatively inexpensive to make and is trouble-free during use.

OBJECTS OF THE INVENTION

A primary object of this invention is to provide a new and improved apparatus for driving or inserting coiled spring pins into holes in workpieces.

A further object of this invention is to provide an apparatus of the type described that is readily adjusted to be used with pins of varying length and diameter and which is inexpensive to manufacture and is quick and easy to use.

Other objects will be in part obvious and in part pointed out in more detail hereinafter.

SUMMARY OF THE INVENTION

This invention is directed to an apparatus for driving or inserting a pin into a hole of a workpiece. Jaw means are supported within a bore of a body for pivotal movement between closed and opened jaw positions. A quill is mounted within the bore for reciprocating movement within the jaw means for driving a pin from the jaw means into a hole in a workpiece, and means are provided for preloading the jaw means to continuously urge it into relatively closed position.

BRIEF DESCRIPTION OF THE DRAWINGS

FIG. 2 is a plan view of a pair of jaws included in the manual pin inserter of FIG. 1;

FIG. 3 is a cross sectional view taken along line 3—3 of FIG. 2;

A better understanding of the objects, advantages, features, properties and relations of this invention will be obtained from the following detailed description and accompanying drawings which set forth an illustrative embodiment and are indicative of the ways in which the principle of this invention are employed.

DETAILED DESCRIPTION OF A PREFERRED EMBODIMENT OF THE INVENTION

Figure 1:
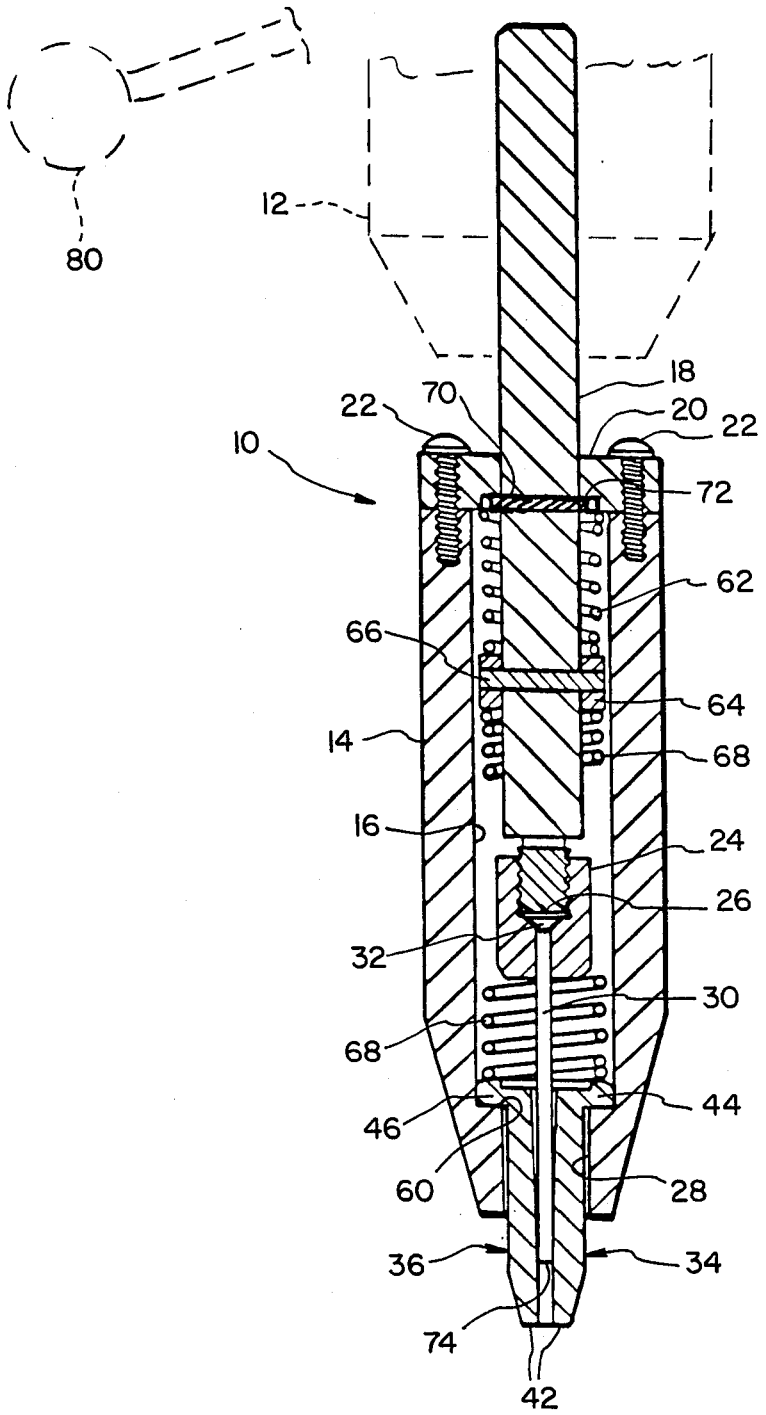
FIG. 1 is a side view, partly in cross section and partly broken away, showing a manual pin inserter of this invention in a pin loading position.

A manual pin driver or inserter 10 of the present invention is illustrated in FIG. 1. It is particularly well suited for use where speed and accuracy of operation is important, where a workpiece into which a coiled spring pin is to be inserted is fragile and other applications wherein quick and easy pin insertion is desired with the use of an inexpensive and reliable pin inserter suitable for extended use with minimum maintenance. The inserter 10 is suitable for mounting in a chuck 12 of a drill press, arbor press or similar machine (not shown) designed for linear reciprocating movement.

Body 14 is tubular and has a cylindrical bore 16 extending coaxially along a major longitudinal axis of the body 14. An actuator or spindle 18 extends into body 14 through a cap 20 fixed to body 14 by machine screws 22 and is suited to be secured at one end within chuck 12. An opposite end of the spindle 18 is threadably connected to a nut 24 having a counterbored opening 26 coaxially aligned within bore 14. A reduced diameter opening 28 is formed in an end of body 14 which opening 28 is in coaxial communication with the bore 14.

A pin inserting quill 30 having an enlarged head 32 seated within the counterbore 26 of the nut 24 is fixed therein by an externally threaded end of spindle 18 for axial reciprocating movement in unison with spindle 18 within a pair of jaws 34, 36 disposed within opening 28 at an end of body 14.

As seen in FIGS. 2 and 3, the jaws 34, 36 comprise split mating jaw halves with each jaw having an elongated tenon 34A, 36A providing a half round jaw face 34B, 36B in confronting relation to one another. The jaw faces 34B, 36B jointly form a circular opening 38 sized to a pin to be inserted into a workpiece. Opposing faces 34B, 36B of the jaws 34, 36 meet along a line of contact 40 (FIG. 2) at an end of the jaws. The jaw faces form an included angle of about 1°, shown as A, from that end of the jaws 34, 36 to an opposite terminal end 42 of the jaws when the jaws are in relatively opened position as illustrated in FIG. 3. Quill 30 is of smaller diameter than jaw opening 38.

In accordance with one feature of this invention, jaws 34, 36 each have a radial flange 44, 46 maintained within body 14. Flanges 44, 46 project radially outwardly from the circular opening 38. The upper surface 47, 47 of each flanged end of the jaws is relieved, forming a raised peripheral segment 48, 50 on each jaw half respectively having an interior edge 52, 54 parallel to the line of contact 40 between the jaws. The upper surfaces 47, 47 extend substantially perpendicular to the longitudinal axis of opening 38. Both the raised segments 48, 50 and the lower faces 56, 58 of each flange 44, 46 extend radially upwardly (as viewed in FIG. 3) at an angle of approximately 1°, shown at B in FIG. 3, relative to the plane containing the upper surfaces 47, 47 of jaws 34, 36.

To continuously maintain body 14 in a relative "up" position wherein the jaws 34, 36 are in fixed engagement with an internal flat annular shoulder 60 within bore 16 at its juncture with the reduced diameter end opening 28 regardless of the relative positioning of the spindle 18 and body 14, a compression spring 62 is seated between cap 20 and a collar 64 which is fastened by pin 66 to spindle 18. A preloading means or compression spring 68 extends between and is seated on collar 64 and the raised segments 48, 50 of the jaws 34, 36. The biasing forces of springs 62, 68 also bias spindle 18 away from the jaws 34, 36 whereby a pin 70 fixed to spindle 18 seats into a circular recess 72 in the bottom of cap 20 to establish a retracted ready position (FIGS. 1, 4 and 5) of the spindle 18 and quill 30.

In that retracted ready position, a driving end or pin engaging end 74 (FIG. 1) of quill 30 is recessed from terminal ends 42, 42 of jaws 34, 36. Quill 30 normally is held in retracted ready position by the biasing force of the compression spring 68. As will be seen, spring 68 urges collar 64 toward cap 20 and spring 62 into a compressed condition. In the retracted ready position, spring 68 effects a jaw preloading action ensuring that jaws 34, 36 are biased into relatively closed position (FIG. 1). In this position, the jaw center opening 38 tapers toward the terminal ends 42, 42 of the jaws. The driving end 74 of the quill 30 in retracted ready position (FIGS. 1, 4 and 5) is in recessed noninterfering relation to the jaws 34, 36 wherein a pin may be loaded into body 14 in its pin loading position (FIG. 1) which will be understood to be in remote relation to a workpiece.

Figure 4:
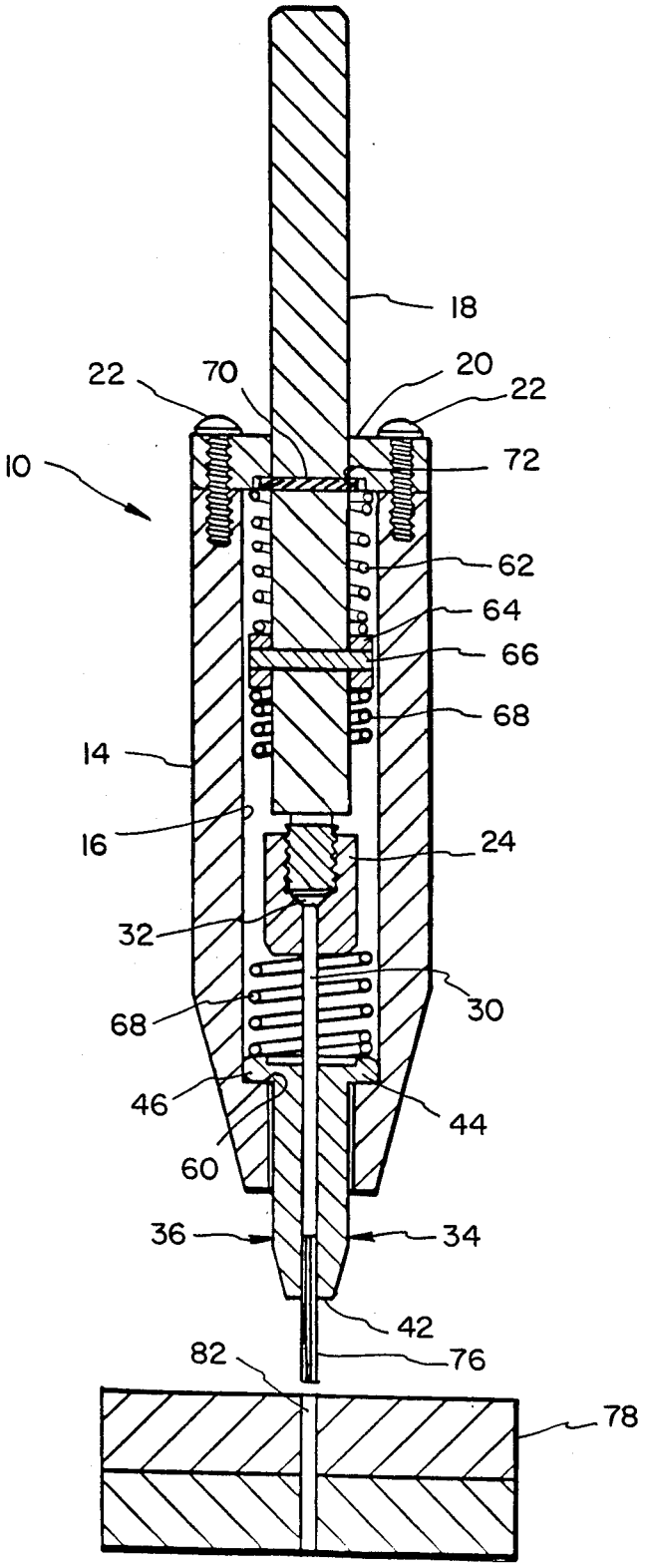
FIG. 4 is a side view, partly in cross section and partly broken away, similar to that of FIG. 1 showing the pin inserter in a pin loaded condition.

To load the pin inserter 10, a pin (such as at 76 in FIGS. 4–6) is placed by hand or other means between jaws 34, 36 with the inserter 10 in pin loading position (FIG. 1) and is pressed within center opening 38 into contact with quill 30. Placement of the pin 76 within that opening 38 (as illustrated in FIG. 4) displaces jaws 34, 36 in a pivoting action away from one another. The length of quill 30 is preselected so that no more than one half the pin length is inserted into jaws 34, 36. The jaws pivot about an axis generally coincident with the line of contact 40 (FIG. 2) between flanges 44, 46. Such pivoting movements of raised segments 48, 50 cause them to move and compress spring 68 to apply an increased linear force against raised flange segments 48, 50 which translates to laterally directed inward forces on jaws 34, 36 to grip the pin 76.

Figure 5:
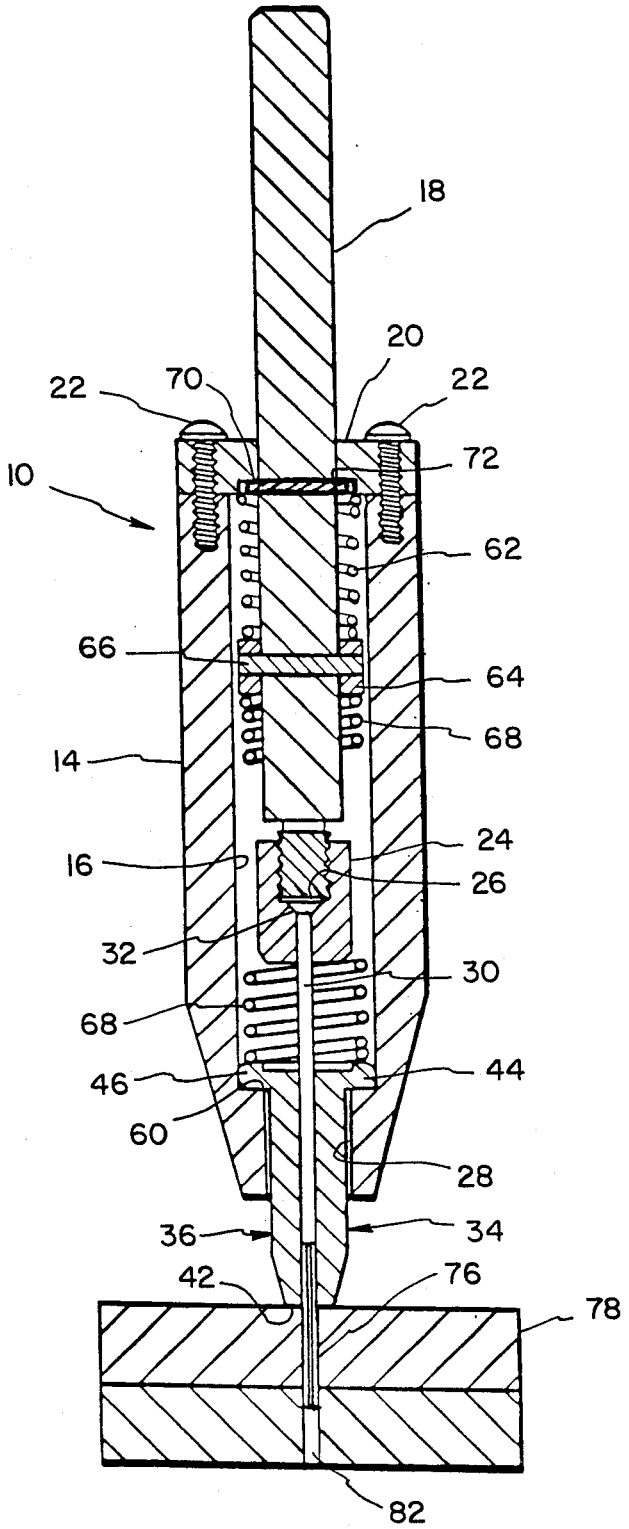
FIG. 5 is a side view, partly in cross section and partly broken away, showing the pin inserter in an operative position with a quill of the inserter in retracted ready position.
Figure 6:
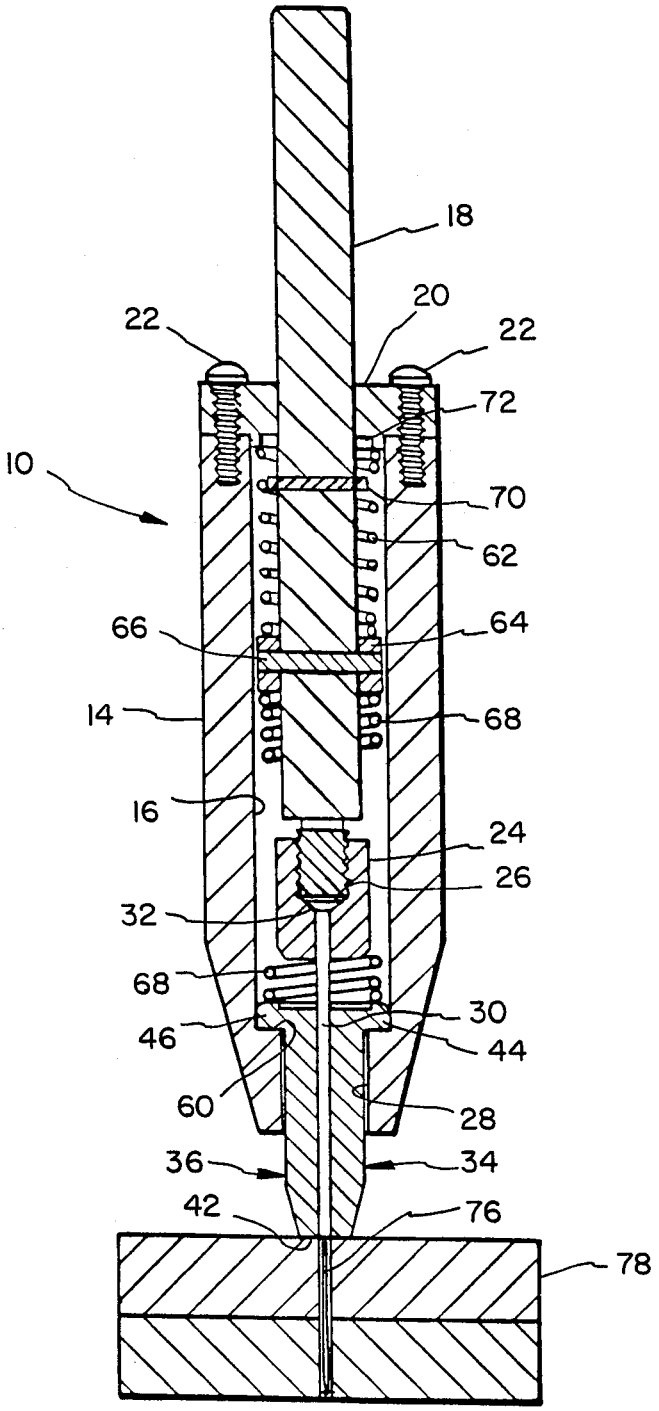
FIG. 6 is a side view, partly in cross section and partly broken away, showing the pin inserter in operative position and its quill in an extended pin inserting position.

Movement of pin 76 into a workpiece such as at 78 is accomplished by operating an actuator or feed lever 80 (FIG. 1) of a drill press (not shown) or the like to advance the pin inserter 10 and the pin 76 retained thereby from a pin loading position into alignment with hole 82 of the workpiece 78 (FIG. 4) and then advancing the pin 76 and inserter 10 as a unit whereby its jaws contact the workpiece 78 in an operative position of body 14 (FIG. 5). Once that contact is established between jaws 34, 36 and workpiece 78 with body 14 in its operative position, movement of the inserter body 14 and its jaws 34, 36 is arrested. Further advancement of spindle 18 by continued advancement of feed lever 80 causes quill 30 to move relative to the body 14, jaws 34, 36 and workpiece 78 until the pin 76 is inserted into the workpiece as assembly specifications may require. I.e., the pin may have a portion protruding above the workpiece; the pin may be fully seated within the workpiece 78 (FIG. 6) flush with its upper surface; or the pin may be recessed a discrete distance below that surface. During such spindle movement, spring 68 is compressed an amount equal to the length of the original penetration of pin 76 into the jaws 34, 36, resulting in a corresponding increase in the jay clamping forces exerted on the pin 76. Quill 30 is dimensioned to be of somewhat smaller diameter than workpiece hole 82 to permit quill penetration as may be required to seat pin 76 below the workpiece surface.

Pin release is achieved by ejection from jaws 34, 36 responsive to quill extension or upon reverse movement of the feed lever 80. The workpiece grip on the pin, which exceeds the jaw clamping forces, retains the pin in its final inserted position.

Reverse movement of the feed lever 80 permits retraction of the quill 30 from its fully extended pin inserting position (FIG. 6) to its retracted ready position (FIG. 1). During this reverse movement, the pin 70 fixed to spindle 18 returns from its displaced position (FIG. 6) into its recess 72 within cap 20 upon movement of the entire pin inserter unit in unison with the spindle return to the original pin inserter starting position above the workpiece.

Pins of different size to be inserted into correspondingly different sized workpiece openings are readily accommodated by simply changing the nut 24, quill 30 and jaws 34, 36 to match the desired pin size to be used in a given pin inserting operation.

As will be apparent to persons skilled in the art, various modifications, adaptations and variations of the foregoing specific disclosure can be made without departing from the teaching of this invention.

I claim:

1. Apparatus for inserting a pin into a hole in a workpiece and comprising a body having a bore therein, jaw means supported on the body within the bore for pivotal movement between relatively closed and relatively opened jaw positions, a quill mounted within the bore for reciprocating movement within the jaw means for driving a pin from the jaw means into a hole in a workpiece, and jaw preloading means for preloading the jaw means to continuously urge it into relatively closed position, the jaw preloading means acting in response to movement of the quill in a pin driving direction for simultaneously applying increased forces to the jaw means in a jaw closing direction.

2. The apparatus of claim 1 further including biasing means for maintaining the jaw means and the body in relatively fixed relation to one another.

3. The apparatus of claim 1 further including an actuator mounted on the body and drivingly connected to the quill for reciprocating the quill between a retracted ready position and an extended pin inserting position.

4. The apparatus of claim 3 wherein the jaw means protrudes beyond one end of the body, wherein the actuator is operable for moving the body between a pin loading position in remote relation to a workpiece and an operative position wherein the jaw means is engaged with the workpiece for registering a pin within the jaw means with a hole in the workpiece, and wherein the actuator is movable relative to the body for driving the quill between its retracted ready position and extended pin inserting position when the body is in its operative position.

5. The apparatus of claim 3 further including a compression spring comprising the preloading means seated between the actuator and the jaw means, the compression spring being compressible upon movement of the quill in a pin driving direction for applying an increased force to the jaw means in a jaw closing direction.

6. The apparatus of claim 1 wherein the bore in the body is generally cylindrical and includes a coaxial end opening of reduced diameter forming an internal annular shoulder adjacent one end of the body, the jaw means including at least two jaws each having at one of its ends a radial flange supported on the internal annular should within the bore for pivotal movement between relatively closed and relatively opened jaw positions.

7. The apparatus of claim 6 wherein the preloading means includes a compression spring seated within the bore and having one end of the spring engaging the radial flanges of the jaws for continuously urging them into relatively closed position.

8. The apparatus of claim 7 further including an actuator for moving the quill between a retracted ready position and an extended pin inserting position, and wherein an opposite end of the spring engages the actuator for applying an increased force on the radial flanges of the jaws to increase the pin clamping force exerted by the jaws as the quill travels from retracted ready position to its extended pin inserting position.

9. The apparatus of claim 6 wherein the radial flange of each jaw has a surface engageable with the annular internal shoulder of the bore, said surface of each radial flange extending outwardly at an angle relative to a radial cross section thereof to provide a pair of tapered flanges for pivotal movements on said shoulder of the bore.

10. The apparatus of claim 9 wherein each jaw has an elongated tenon extending through the reduced diameter end opening of the body, each tenon forming a half round jaw face in confronting relation to the other tenon, wherein the jaw faces jointly form a circular opening at the flanged end of the jaws which opening is sized to a pin to be inserted into a workpiece, and wherein the jaw faces are shaped and configured such that the jaw faces form an included angle from the flanged end of the jaws to an opposite terminal end of the jaws when the jaws are in relatively opened position.

11. The apparatus of claim 10 wherein the opposite terminal end of the jaws is countersunk.

12. The apparatus of claim 10 wherein a pin engaging end of the quill in its retracted ready position is disposed between said ends of the jaws, and wherein the pin engaging end of the quill in its extended pin inserting position is located beyond the terminal end of the jaws.

13. The apparatus of claim 6 wherein each jaw is supported for movement about a pivot axis extending generally in perpendicular relation to a longitudinal axis of the body.

14. The apparatus of claim 6 wherein a spindle is mounted within the body and is drivingly connected to the quill, wherein a cap is fixed to the body in surrounding guiding relation to the spindle, wherein a collar is fixed to the spindle intermediate its ends with the bore, and wherein a first compression spring comprising the jaw preloading means is seated between the collar and the jaws.

15. The apparatus of claim 14 wherein a second compression spring is seated between the collar and the cap for continuously maintaining the jaws and the body in operative engagement.

16. The apparatus of claim 15 wherein the first and second compression springs are in coaxial surrounding relation to the spindle.

17. The apparatus of claim 7 wherein each jaw has a raised segment on its radial flange in engagement with a compression spring seated within the bore and comprising said jaw preloading means.

* * * * *